US006097368A

United States Patent [19]

Zhu et al.

[11] Patent Number: 6,097,368

[45] Date of Patent: Aug. 1, 2000

[54] MOTION PIXEL DISTORTION REDUCTION FOR A DIGITAL DISPLAY DEVICE USING PULSE NUMBER EQUALIZATION

[75] Inventors: Daniel Qiang Zhu, Columbus; Thomas J. Leacock, Medford, both of N.J.; James D. Noecker, Saugerties, N.Y.

[73] Assignee: Matsushita Electric Industrial Company, Ltd., Osaka, Japan

[21] Appl. No.: 09/052,754

[22] Filed: Mar. 31, 1998

[51] Int. Cl.[7] ..... G09G 3/28

[52] U.S. Cl. ..... 345/153; 345/63; 345/147; 345/148

[58] Field of Search ..... 345/147, 148, 345/153, 63

[56] References Cited

U.S. PATENT DOCUMENTS

| | | | |
|---|---|---|---|
| 4,368,491 | 1/1983 | Saito | 358/460 |
| 5,204,664 | 4/1993 | Hamakawa | 345/154 |
| 5,436,634 | 7/1995 | Kanazawa | 345/67 |
| 5,841,413 | 11/1998 | Zhu et al. | 345/63 |

FOREIGN PATENT DOCUMENTS

| | | |
|---|---|---|
| 766 222 A1 | 4/1997 | European Pat. Off. . |
| 833 299 A1 | 4/1998 | European Pat. Off. . |
| 2 740 253 | 4/1997 | France . |
| WO 90/12388 | 10/1990 | WIPO . |
| WO 94/09473 | 4/1994 | WIPO . |

OTHER PUBLICATIONS

S. Mikoshiba "Picture Quality Issues for Color Plasma Displays" The University of Electro–Communications, Japan (1995).

K. Toda et al. "An Equalising Pulse Technique for Improving the Grey Scale Capability of Plasma Display" Displays Euro Display '96 pp. 39–42.

Y. W. Zhu et al. A Motion–Dependent Equalizing–Pulse Technique for Reducing Dynamic False Contours on PDPs.

Nakamura, T. et al. "Drive for 40 inch Diagonal Full Color AC Plasma Display" vol. XXVI, pp. 807–810 SID International Symposium Digest of Technical Papers, May 1995.

EPO Search Report, Oct. 20, 1998.

*Primary Examiner*—Bipin Shalwala
*Assistant Examiner*—Vincent E. Kovalick
*Attorney, Agent, or Firm*—Ratner & Prestia

[57] ABSTRACT

A digital display device, such as a plasma display or a digital micromirror device (DMD) based digital light projector, employs a minimum moving pixel distortion (MPD) set of codewords for reducing visually perceived artifacts viewed on a digital display device (PDP). The digital display device includes a minimum MPD mapping process, which maps by, for example, a ROM look-up table, corresponding present and previous pixel intensity values from first and second image frames into a preferred equalizing code value corresponding to the present pixel intensity value. An optimal set of equalizing codewords is determined by comparing objective measures of MPD error for each of a plurality of trial equalizing codewords and selecting the codeword having the smallest measure of MPD error. The optimal equalizing codewords are stored in a ROM lookup table which is addressed by the previous and current codewords. Each current codeword and its corresponding codeword from a previous frame are applied to the ROM lookup table which provides the corresponding equalized codeword. This equalizing codeword replaces the current codeword in the display data. The digital display device controller then provides the display data, line by line, to the digital display device (PDP) using a scan driver and a data driver. Once the display data is loaded into the PDP for an image, the digital display device controller enables the sustain pulse drivers to illuminate the addressed cells with the intended sustain pulse train encoded by the codeword.

7 Claims, 6 Drawing Sheets

MOTION PIXEL DISTORTION REDUCTION FOR A DIGITAL DISPLAY DEVICE USING PULSE NUMBER EQUALIZATION

FIELD OF THE INVENTION

The present invention related to any digital display devices which utilize pulse number (or pulse width) modulation techniques to express any gray scale or color image in digital form, such as in the case of plasma display panels and DMD-based digital light projectors, more particularly, the present invention relates to a method and a apparatus which, respectively, determine and apply equalization pulses to be added to or subtracted from an existing pulse value that expresses certain gray-scale intensity for above mentioned display devices.

BACKGROUND OF THE INVENTION

Plasma display panels normally use a pulse number modulated binary-coded light-emission-period (discharge period) scheme for displaying digital images with certain gray-scale depth. For a typical 8-bit panel (8-bit system), there are $2^8$=256 possible intensity or gray-scale levels for each of the red, green and blue primary color signals. To translate each data bit into a proper light intensity value on the screen, one TV frame period is divided into 8 subfield periods corresponding to bit 0 through bit 7 of a binary-coded pixel intensity. The number of light-emission pulses (sustain pulses) of each discharge period for a cell in the panel varies from 1, 2, 4, 8, 16, 32, 64 to 128 for subfields 1 to 8 respectively. Although this binary-coded scheme is adequate for displaying still images, annoying false contours (contour artifacts) may appear in the image when either a subject within the image moves, or viewer's eyes move relative to the subject. This phenomenon is termed moving pixel distortion (MPD).

In order to address this problem, some systems employ MPD correction with equalization pulses. In this situation, the transition between subfields that may cause a contour artifact is detected and a light emission pulse is added or subtracted before the transition occurs. To date, these systems have identified only a few transitions for equalization and the particular equalization pulses to add have been determined experimentally. Furthermore, a sophisticated and costly motion estimator is needed to achieve motion-dependent equalization. Other systems may employ a modified binary-coded light-emission method to scatter the contour artifacts. By increasing the number of subfields from, for example, from 8 to 10 in a 8-bit panel, the method redistributes the length of the two largest light-emission blocks into four blocks with equal length (e.g., 64+128=48+48+48+48). To retain the same total number of pulses as used in the traditional system, the number of sustain pulses included in each of these four newly formed blocks is 48. The contour artifacts that may appear in this modified system are scattered through the image. The result is a more uniform temporal emission achieved by randomly selecting one of the many choices which have the same number of pulses for a given pixel value. When randomization is done at each pixel level, however, the contour artifacts may be transformed into moiré-like noise which, in some circumstances, may be a little bit less annoying to the viewer. This form of system only scatters the artifacts, it does not try to minimize them. In addition, because subfields are reserved for artifact compensation, the color resolution of the images that can be produced is reduced relative to a display device which uses 10 subfields and does not redistribute errors.

SUMMARY OF THE INVENTION

The present invention relates to a method for determining a when to add equalization pules to pulse number modulated (PNM) data to be displayed on a plasma display device in order to reduce moving pixel distortion (MPD). The method objectively analyzes each possible transition to determine the likely magnitude of the resulting MPD. The method then selectively adds equalization pulses and objectively analyzes the MPD of the equalized codes. For each possible transition, the method records the equalized PNM code that produces the least MPD. In operation, the display system monitors corresponding pixel values from an adjacent frame and substitutes an equalized PNM code as appropriate to reduce the MPD resulting from a transition in the image from one frame to the next.

BRIEF DESCRIPTION OF THE DRAWINGS

These and other features and advantages of the present invention will become apparent from the following detailed description, taken in conjunction with the accompanying drawings, wherein.

DETAILED DESCRIPTION

General Description of Plasma Display Device

The invention is described in terms of a plasma display as an exemplary embodiment. The application of the current invention, however, is independent of the particular type of a digital display device as long as it employs pulse number modulation or pulse width modulation techniques to express any gray scale or color image in digital form.

Figure 1:
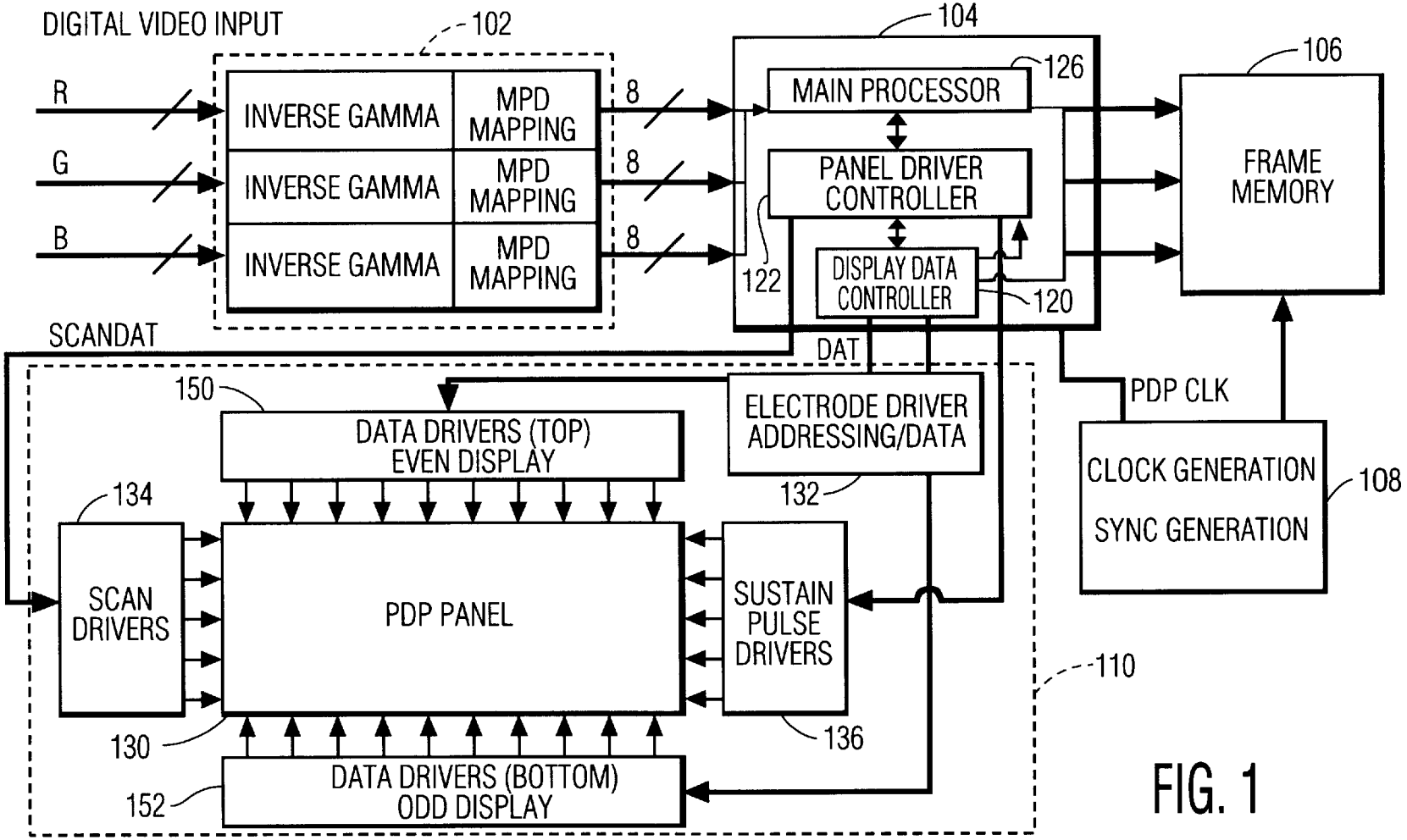
FIG. 1 is a high level block diagram of a simplified 8-bit plasma display device as is employed in one embodiment of the present invention.

FIG. 1 is a simplified block diagram of a plasma display device as is employed with one embodiment of the present invention. As shown, the plasma display device includes intensity mapping processor 102, plasma display controller 104, frame memory 106, clock and synchronization generator 108 and plasma display unit 110.

The intensity mapping processor 102 receives digital video input, pixel by pixel, of a video image frame. The image frame may be of progressive format or interlace format. For the sake of simplicity, a progressive format is assumed in the materials that follow. Thus, the terms frame and field are used interchangeably. For color images, the video input data for each pixel may consist of a red intensity value, a green intensity value and a blue intensity value. For the sake of simplicity, the following discussion only assumes one gray scale intensity value is being used. The intensity mapping processor 102 includes, for example, a look-up table or mapping table that translates the pixel intensity value to one of a group of intensity levels. Each one of the group of intensity levels is defined by a binary codeword. In the exemplary embodiment of the invention, each of the red, green and blue pixel values is an eight-bit binary value. A method according to the present invention objectively analyzes transitions between eight-bit pixel values from one frame to the next and selectively adds or subtracts bits in order to add or subtract sustain pulses when the pixel value is reproduced. The bits are added or subtracted to minimize the objective measure of MPD for the transition. To use the transition codes determined by this method, the intensity mapping processor 102 includes a frame delay element which provides the value of the pixel element from the previous frame to the intensity mapping processor 102 along with the current value of that pixel element. The processor 102 recognizes transitions that may benefit from equalization and changes the value of the current pixel element to add or subtract equalization pulses as determined by the above method.

The intensity mapping processor 102 may also include an inverse gamma correction sub-processor which reverses the gamma correction that was performed on the signal at the source. This gamma correction adjusts for nonlinearities in the reproduction of images on cathode ray tubes (CRTs). The exemplary plasma display device does not need gamma correction. Accordingly, the inverse gamma correction circuitry reverses the gamma correction algorithm that was applied at the signal source.

The frame memory 106 stores display data which is the intensity level, in equalized PNM format, for each pixel of a scan line of a frame and a corresponding address for the plasma display unit 110 determined by the plasma display controller 104.

Figure 2A:
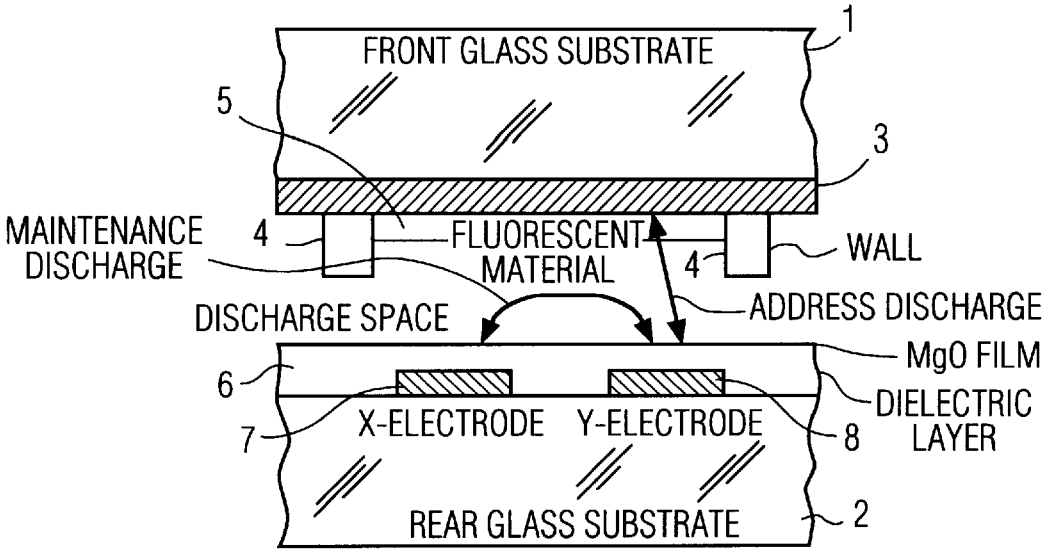
FIG. 2A PRIOR ART
FIG. 2A (Prior Art) is a side plan view of a single cell of a plasma display device which illustrates a cell arrangement of a three electrode surface discharge alternating current PDP as is used in an exemplary embodiment of the present invention.
Figure 2B:
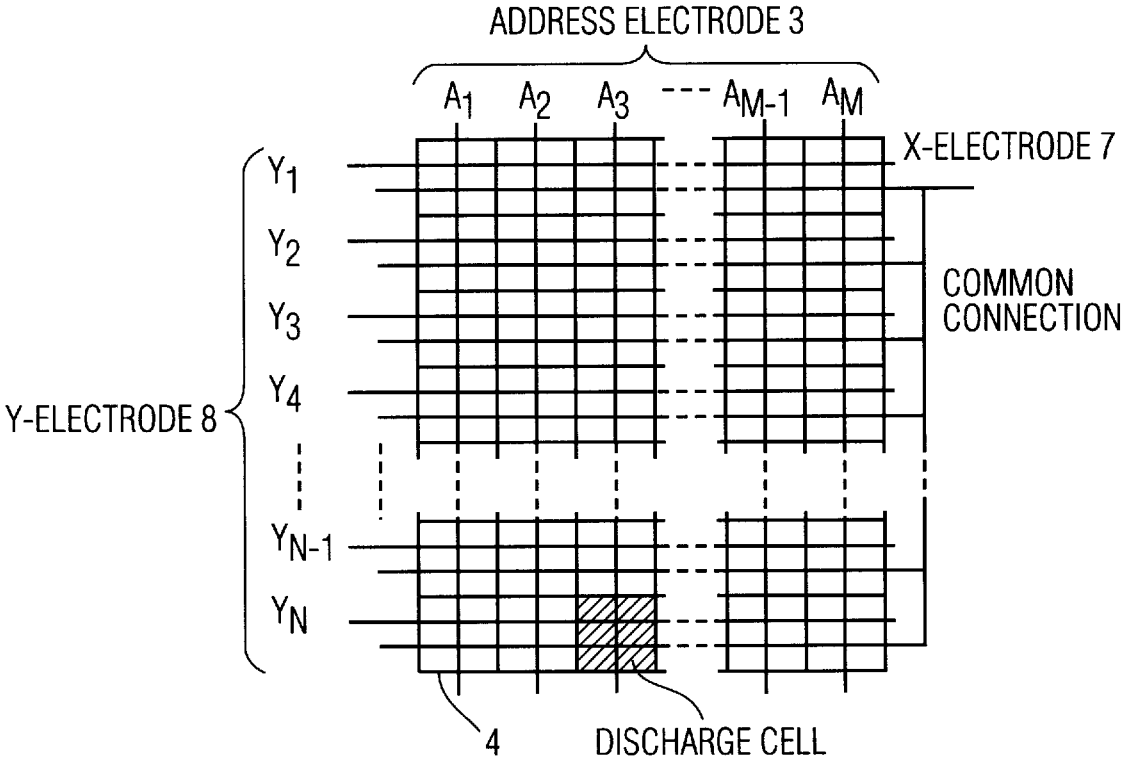
FIG. 2B PRIOR ART
FIG. 2B (Prior Art) is a partial top plan view of a plasma display which illustrates an H×V matrix of cells as illustrated in FIG. 2*a*.

The plasma display unit 110 further includes a plasma display panel (PDP) 130, an addressing/data electrode driver 132, scan line driver 134, and sustain pulse driver 136. The PDP 130 is a display screen formed using a matrix of display cells, each cell corresponding to a pixel value to be displayed. The PDP 130 is shown in more detail in FIGS. 2*a* and 2*b*. FIG. 2*a* illustrates an arrangement of a three electrode surface discharge alternating current PDP 130. FIG. 2*b* shows the matrix formed by H×V cells, where H is the number of cells on a row of the matrix and V is the number of cells on a column.

As shown in FIG. 2*a*, each cell in the PDP 130 is formed between a front glass substrate 1 and a rear glass substrate 2. The cell includes an addressing electrode 3, an intercell barrier wall 4, and a fluorescent material 5, deposited between the walls. The PDP cell is illuminated by a potential established and maintained between an X electrode 7, the addressing electrode 4 and a Y electrode 8. The X and Y electrodes are covered by a dielectric layer 6. Light emission in the cell is established by an addressing electrical discharge between the addressing electrode and the Y electrode 8. The Y electrodes are scanned line by line while the addressing electrodes apply a potential to the cells on the line that are to be illuminated. The difference in potential between the Y electrode and the addressing electrode causes a discharge which establishes an electrical charge on the barrier walls of the cell. Light emission in a charged cell is maintained through application of sustain pulses (also known as sustain or maintenance discharges) between the X and Y electrodes. The sustain pulses are applied to all of the cells in the display but an illuminating discharge occurs only in those cells which have an established wall charge.

The addressing/data electrode driver 132 (shown in FIG. 1) receives the display data for each line of the scanned image from the frame memory 106. As shown, the exemplary embodiment includes addressing/data electrode driver 132 which may also include separate display data drivers 150 for the upper and lower portions of the display. By enabling the addressing/electrode driver 132 to process the upper and lower portions of the display separately, the time to retrieve and load data may be reduced. However, the present invention is not so limited, and a single addressing/data electrode driver 132 sequentially receiving data for the entire display may also be used. Display data consists of each cell address corresponding to each pixel to be displayed, and the corresponding intensity level codeword (determined by the intensity mapping processor 102).

The scan line driver 134, responsive to control signals from the plasma display controller 104, sequentially selects each line of cells corresponding to the scanning line of the image to be displayed. The scan line driver 134 works with the addressing/data electrode driver 132 to erase the wall charge from each cell and then selectively establish a wall charge on each cell that is to be illuminated. Each cell is either turned on or turned off for a subfield sustain interval during the addressing interval of the subfield period. The relative brightness of a cell is determined by the amount of time (number of sustain pulses) in any field interval in which the cell is illuminated.

The sustain pulse driver 136 provides the train of sustain pulses for maintenance discharge corresponding to the selected display data value. As shown previously, the X electrodes of the PDP are tied together. The sustain pulse driver 136 applies sustain pulses for a period of time (maintenance discharge period) to all cells for all scan lines; however, only those cells which have a wall charge will experience a maintenance discharge.

The plasma display controller 104 further includes a display data controller 120, a panel driver controller 122, main processor 126 and optional field/frame interpolation processor 124. The plasma display controller 104 provides the general control functionality for the elements of the plasma display unit.

The main processor 126 is a general purpose controller which administers various input/output functions of the plasma display controller 104, calculates a cell address corresponding to the received pixel address, receives the mapped intensity levels of each received pixel, and stores these values in frame memory 106 for the current frame. The main processor 126 may also interface with the optional field/frame interpolation processor 124 to convert stored fields into a single frame for display.

The display data controller 120 retrieves stored display data from the frame memory 106 and transfers the display data for a scan line to the addressing/data electrode driver 132 responsive to a drive timing clock signal from the clock and synchronization generator 108.

The panel driver controller 122 determines the timing for selecting each scan line, and provides the timing data to the scan line driver 134 in concert with the display data controller transferring the display data for the scan line to the addressing/data electrode driver 132. Once the display data is transferred, the panel driver controller 122 enables the signal for the Y-electrodes for each scan line to ready the cell for the maintenance discharge.

To facilitate an understanding of the method of the present invention, the use of binary codewords for representing intensity levels of the pixels as is known in the prior art is now described.

Figure 3:
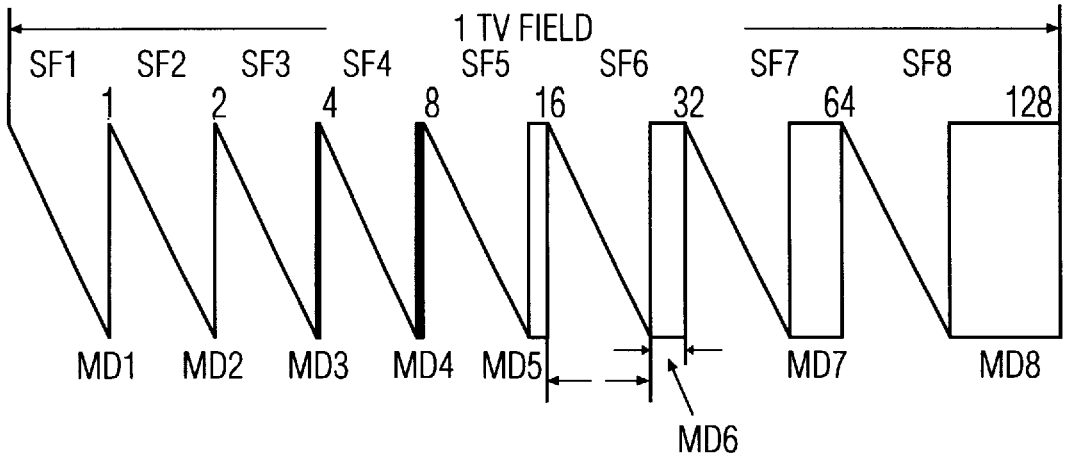
FIG. 3 (Prior Art) is a timing diagram which illustrates timing of a conventional PDP driving method employing binary codewords to achieve 256 intensity levels as is known in the prior art.

FIG. 3 illustrates the timing of a conventional PDP driving method employing binary codewords to achieve 256 intensity levels as is known in the prior art. The cell address and binary codeword value are stored in, and retrieved from, memory as display data. In FIG. 3, an image frame is divided into 8 subfields SF1 through SF8. The number of sustain pulses of each maintenance discharge period for a cell in the panel varies among 1, 2, 4, 8, 16, 32, 64, and 128 for subfields 1 to 8 respectively. Each subfield has a corresponding defined bit 0 through bit 7 of the pixel code word. Each subfield is divided into a fixed-length addressing interval, AD (having a line sequential selection sub-interval, an erase sub-interval and a write sub-interval), and a maintenance discharge period, MD1 through MD8 in which sustain pulses are applied to the cell to emit light. As is shown, the of the number of sustain pulses, $T_{SUS}$(SFi), i=1–8, for each of the discharge periods for this scheme is in a ratio of 1:2:4:8:16:32:64:128.

To display an image, the required level of intensity for each of the pixels in the image on a line by line basis is determined by the intensity mapping processor 102. The plasma display controller 104 converts the pixel address into a cell address, and converts the intensity level into a binary codeword value. As described previously, the binary codeword value is an 8 bit value, with each bit position in the 8-bit value enabling or disabling illumination during a corresponding one of the 8 subfields.

The subfield addressing operation begins with an erase discharge operation in which the wall charge on all cells in the line is erased. Each cell in the line is then selected to receive a wall charge based on the value of the bit in its corresponding intensity value that controls illumination during the corresponding subfield. Once all of the cells in the image have been addressed and appropriate wall charges have been established for a particular subfield period, the sustain pulses for the subfield are applied, and the cells having a wall charge are illuminated.

The binary-coded method described above is effective only when brightness variations occur quickly and are integrated into a single average brightness variation by the viewer's eyes. At least for certain transitions, however, the human eye does not completely integrate the changes in brightness causing annoying false contours to appear. These contours appear in moving images and in certain still images when the viewer scans across the image. This phenomenon is termed moving pixel distortion (MPD). A gray scale transition of a pixel from 127 to 128, for example, using the brightness mapping described above will trigger MPD due to the uneven temporal distribution of the sustain pulses. Because of human visual characteristics, the perceived intensity level for this transition is not sustained in the range of 127 or 128 but is reduced to a lower value.

The present invention makes the following assumption about the transition it deals with. It is assumed that there are always three levels involved in the temporal transition for every pixel in the panel, namely an x-y-y transition. Should this assumption become invalid, the result may be sub-optimal. Specifically, the present invention attempts to modify the value of the first y involved in the transition of interest. Equivalently, a N-bit binary representation of the first y is altered such that some one bits will become zero bits and vice-versa.

Equalization of a Multibit Code for Improved MPD Error Performance

The present invention selects a sustain pulse timing scheme which distributes the brightness levels produced by a transition from a first N-bit code value to a second N-bit code value by selectively inserting or deleting selected bits from the second N-bit code value.

A first step in this method is to define a model for the perceived intensity level at the retina, r(t) so that there can be an objective way to measure MPD. This approximation is given in equation (1).

$$r(t) = \int_t^{t+T} i(u)du \tag{1}$$

where T is one TV field period (normalized to 1023 time units). Note that the partial sum of i(t) over each subfield with the exact subfield boundary should yield the exact sustain period of that subfield. The partial sum of i(t) over each TV field with the exact field boundary should coincide with the expressed intensity level.

As a practical model, a simplified time-varying, exponentially decaying rectangular impulse response for the retina is assumed in (1). The inventors have determined that this model provides sufficient accuracy for the MPD equalization method. It is contemplated, however, that other, more sophisticated retinal models may be used.

To calculate MPD error, it is desirable to have an ideal perceived intensity curve for a given transition. Although, this intensity curve should be a step function between the two transition levels, it is difficult to precisely define when during the interval between the two levels, the transition should occur. For this method, the error is defined as the minimum of the errors between each of the two levels. Mathematically, the MPD mean-square-error (MSE), e, for the transition between gray scale level x and gray scale level y is defined by equation (2).

$$e = \frac{1}{T}\sqrt{\int_T \min\{e_1(t)^2, e_2(t)^2\}dt} \tag{2}$$

where $e_1(t)=|r(t)-x|$ and $e_2(t)=|r(t)-y|$.

Figure 5A:
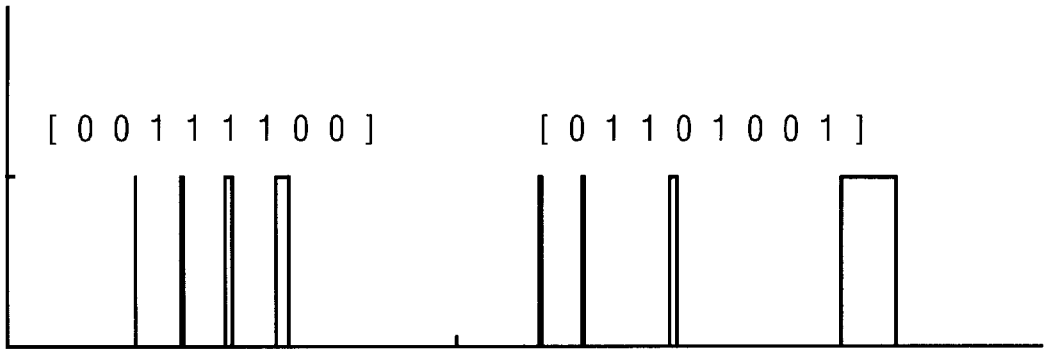
FIG. 5A is a timing diagram of a transition in an image which is useful for describing a method for measuring the MPD error resulting from a transition.
Figure 5B:
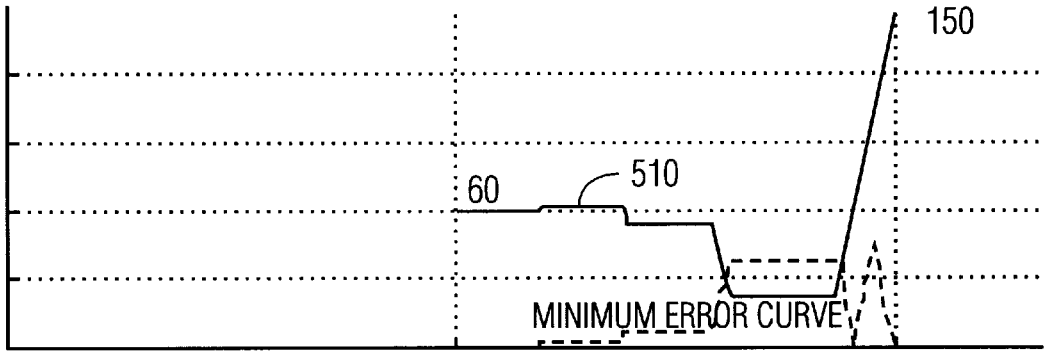
FIG. 5B is a graph of the apparent intensity for the transition shown in FIG. 5A including an indication of the measured MPD error.

FIGS. 5A and 5B show the minimum error curve for a transition between 60 and 150 using an 8-bit binary code. The solid-line curve 510 represents the perceived intensity as modeled by equation (1) and the dashed line curve 520 represents the MPD error (i.e. $\min(e_1(t),e_2(t))$ for the transition according to equation (2).

The inventors have determined several advantages for using the MPD MSE: first, there is no assumption of eye movement; second, the degree of MPD artifact translates into MPD MSE, that is to say, the bigger the MSE, the worse the MPD artifact; and third, MPD MSE can be used as an objective function to find an effective MPD reduction scheme.

One factor which affects the degree of MPD for a given pulse number modulation (PNM) code is the number of sustain pulses that are assigned to each bit. A particular assignment of sustain pulses to bits in PNM is referred to as a SP. In general, an SP is defined as a vector of pulse numbers associated with the bits of an intensity value. The generalized SP for an 8-bit PNM is set forth in equation (3)

$$SP=[sp_1, sp_2, sp_3, sp_4, sp_5, sp_6, sp_7, sp_8] \quad (3)$$

For example, the PNM code shown in FIG. 3 has may be represented as SP=[1, 2, 4, 8, 16, 32, 64, 128]. The inventors have determined that the MPD performance of a plasma display device may be improved by selecting an alternate SP. For example, the SP [16, 8, 4, 2, 1, 128, 64, 32] has better overall MPD performance than either the SP [1, 2, 4, 8, 16, 32, 64, 128] or the SP [128, 64, 32, 16, 8, 4, 2, 1].

In the exemplary method, for a particular SP, each possible transition from a first level to a second level for a given N-bit code is analyzed according to the objective function and equalizing bits are selectively set and reset in the value representing the second level to minimize the objective function. The method of assigning equalization pulses according to the present invention assumes that the second level is maintained. Accordingly, the added equalization pulses should not create significant additional MPD in a transition from the equalized second value to an unequalized second value. The unequalized transition from the previous pixel value, x, to the current pixel value, y, to the next pixel value, y, is represented by notation (4).

$$x \rightarrow y \rightarrow y \quad (4)$$

The goal of the equalization process is to identify an equalizing value, eq, which, when added to the current pixel value, produces a minimum value for the objective function. If the equalized transition is represented by equation (5), then the objective function may be represented by equations (6), (7), (8) and (9) where equation (9) represents the retinal response of the transition shown in equation (5).

$$x \rightarrow y_{eq} = y + eq \rightarrow y \quad (5)$$

$$e = \frac{1}{2T}\sqrt{\int_{2T} \min\{e_1(t, y_{eq})^2, e_2(t, y_{eq})^2\} dt} \quad (6)$$

where:

$$e_1(t, y_{eq}) = |r(t, y_{eq}) - x| \quad (7)$$

$$e_2(t, y_{eq}) = |r(t, y_{eq}) - y| \text{ and} \quad (8)$$

$$r(t, y_{eq}) = \int_t^{t+2T} i(u, x, y_{eq}, y) du \quad (9)$$

Ignoring the transition from zero to one, for an 8-bit coding system, there are at most 255 values that $y_{eq}$ can be. One possible method for developing an equalization map for the code set is to exhaustively analyze all possible transitions. This entails analyzing $255^2$=65,025 transitions.

Figure 4A:
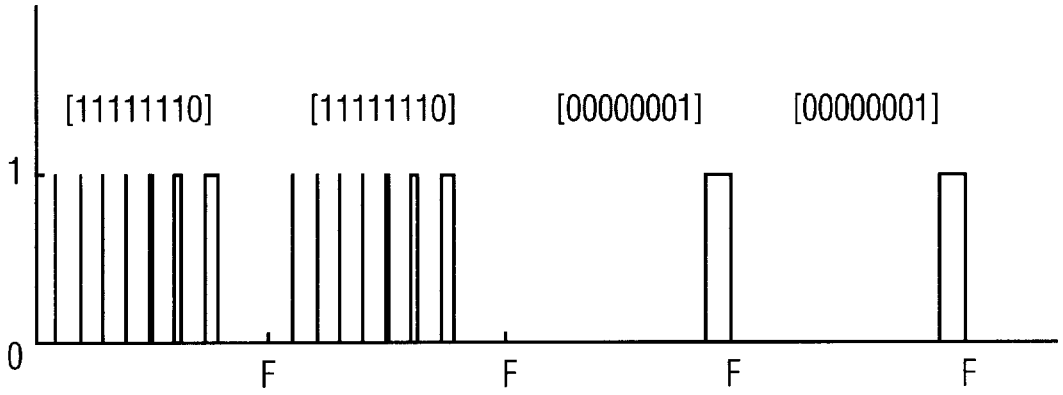
FIG. 4A is a timing diagram of a transition in an image which is useful for describing moving pixel distortion.
Figure 4B:
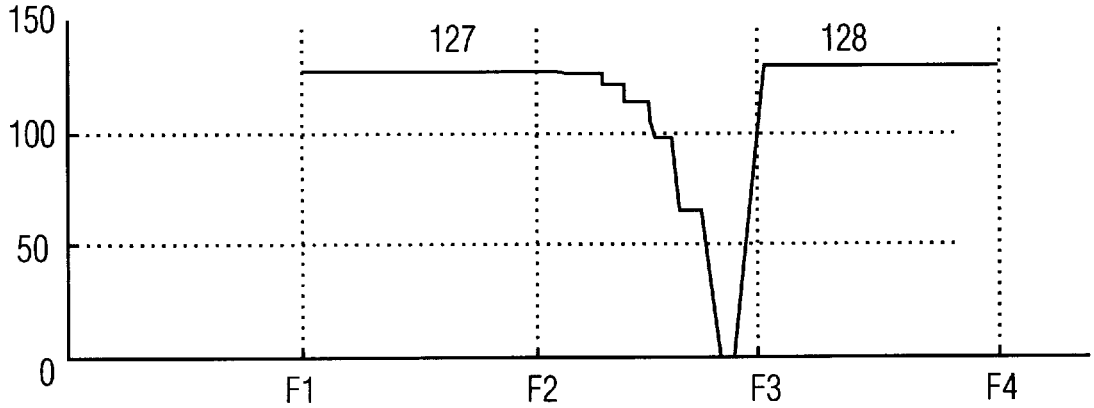
FIG. 4B is a graph of apparent intensity for the transition shown in FIG. 4A.
Figure 6:
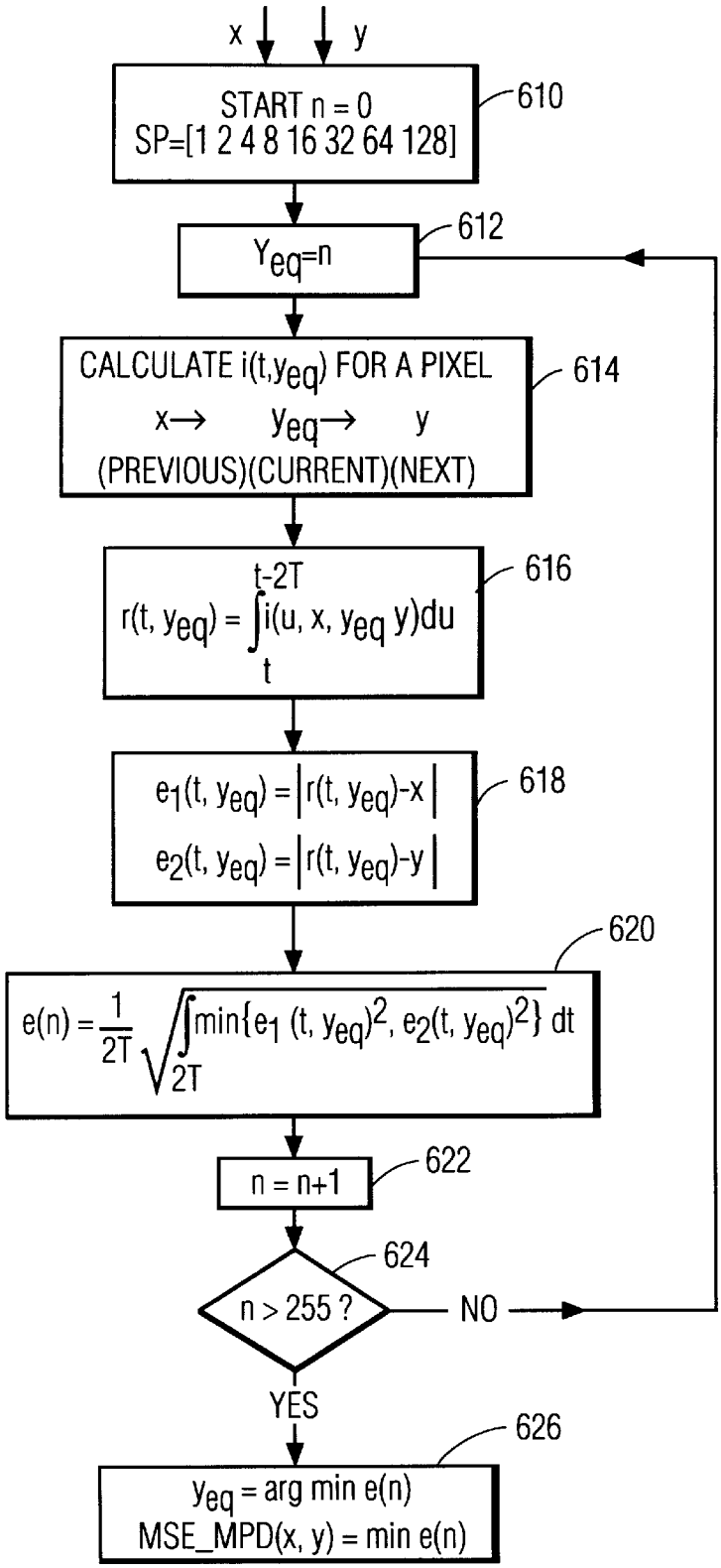
FIG. 6 is a flow-chart diagram of a method according to the present invention.

FIG. 6 is a flow-chart diagram of a code equalization process in accordance with the subject invention. This flow-chart diagram represents an inner loop of the process. The outer loop steps through each of the 65,025 possible transitions in the code and assigns codes to the pixel value before the transition, x, and the pixel value after the transition, y. The first step in the equalization process, step 610, receives the values for x and y and assigns a value of zero to the loop variable n. At step 612, $y_{eq}$ is assigned the current value of the variable n. At step 614, the process calculates the value of $i(t,x,y_{eq},y)$ for the pixel. As set forth above, the function $i(t,x,y_{eq},y)$ determines the retinal response for a transition from x to $y_{eq}$ to y. The retinal response used in the exemplary embodiment of the invention the retinal response is modeled as a moving average during discrete time intervals. For each field period, 1024 normalized time units are defined. The gradual decay begins immediately after the occurrence of a pulse and is reset to full value by the occurrence of the next subsequent pulse. An exemplary decay of this function is shown in FIG. 4B.

In the next step, 616, the function $i(u,x,y_{eq},y)$ is integrated over the two field period of the transition from x to $y_{eq}$ to y according to equation (9). At step 618, the modeled MPD error functions are determined for the current value of $y_{eq}$ for the values x and y according to equations (7) and (8). At step 620, the MSE MPD value for the current value of $y_{eq}$ is determined and stored. At step 622, the loop variable n is incremented and, at step 624, if n not greater than 255, control is transferred back to step 612 to determine the MSE MPD for the next value of $y_{eq}$. If at step 624, however, n is greater than 255, control is transferred to step 626 which determines the value of $y_{eq}$ that corresponds to the minimum MSE MPD. This value is stored, at step 626, for use in equalizing the transition from x to y for the PNM code. In addition, at step 626, the minimum value of the MSE MPD for this transition is stored. This value may be used, as described below, to evaluate the performance of different SPs.

Although the process shown in FIG. 6 is described as the inner loop of an outer loop which exhaustively tests each possible transition in the PNM code, it is contemplated that the process may be used in other ways. For example, the outer loop may calculate an error for a transition from pixel value x to pixel value y according to equation (2) above and compare that error to a threshold. In this alternative embodiment, the process shown in FIG. 6 would be invoked only if the error exceeds the threshold. The process shown in FIG. 6 may also be modified to determine the minimum MSE MPD as the process executes. For example, at step 620, the currently calculated value for e(n) may be compared with a previous minimum value and replace the previous minimum value if the current value is less. In this alternative embodiment, the value of n corresponding to the new minimum value may also be stored.

The process described above may also be used to compare the performance of different SPs. As set forth above, after step 626 has been performed for the final combination of x and y, there is an array MSE_MPD which contains the minimum MSE MPD for each transition for the given sustain pulse assignment SP. If the SP is changed and the process is repeated, an array of MSE MPD may be generated for this alternate SP as well. The MSE MPD of the two SPs may then be compared to determine which results in the lower MSE MPD. It is contemplated that this comparison may evaluate the individual SPs according to several different criteria such as the smallest average MSE MPD, the maximum MSE MPD or the median MSE MPD. In a more complete evaluation, all of these factors may be calculated and weighted to determine a metric which defines the effectiveness of the SP for the particular PNM code.

Figure 7:
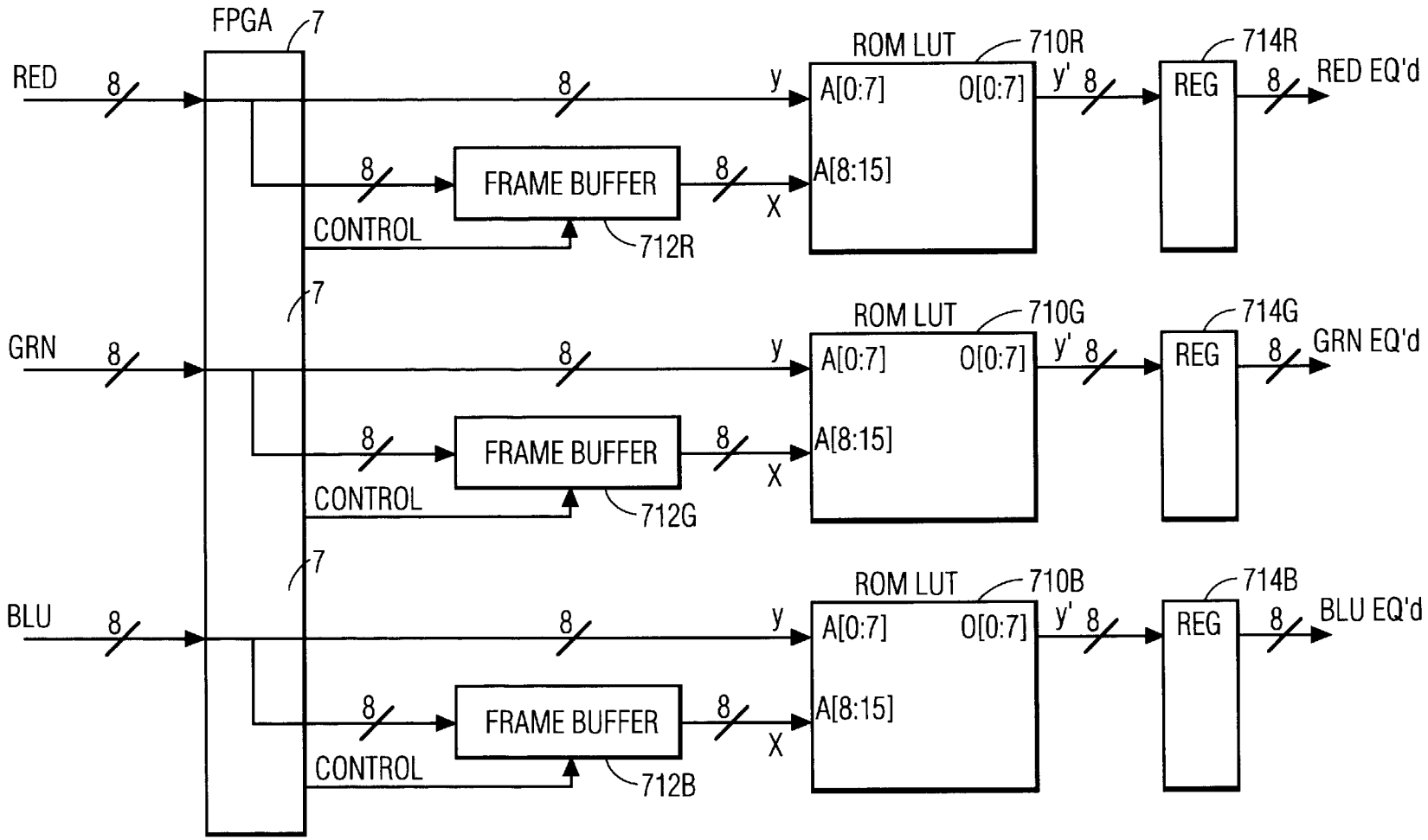
FIG. 7 is a block diagram of a pixel value translation memory which uses the equalized MPD code developed using the method shown in FIG. 6.

FIG. 7 is a block diagram of circuitry suitable for use as the MPD equalization circuitry 102 of FIG. 1. Once the optimal equalization values have been determined, the argument values determined in step 626 for each of the transitions that were analyzed may be stored into read only memories (ROMs) 710R, 710G and 710B shown in FIG. 7. Each of the ROMs 710R, 710G and 710B includes a 16-bit address port which receives the values x, representing the pixel value from the previous frame, and y, representing the current pixel value, as a single address value and provides the stored argument value, y', as the equalized output value. These equalized output values, y', then replace the pixel value y in the current image.

As shown in FIG. 7, the input pixel values for the red, green and blue primary color signals are applied to a programmable logic array (PLA) 708, which generates control signals for frame buffers 712R, 712G and 712B and also applies the received red, green and blue pixel values to both the respective ROMs 710R, 710G, and 710B and to the respective frame buffers 712R, 712G and 712B. The frame buffers are controlled to produce the pixel from the previous frame that corresponds in position to the current pixel at their output ports. Thus, if y represents the red signal component of the first pixel in the first line of the current image frame then x represents the red component of the first pixel in the first line of the previous image frame. The address value for the ROMs 710R, 710G, and 710B is generated by concatenating the respective x and y pixel values. The equalized output values, y', of the ROMs 710R, 710G, and 170B are stored in respective registers 714R, 714G, and 714B to synchronize the equalized red, green and blue color signals for further processing.

The exemplary embodiments of the present invention have been described with reference to a plasma display panel having an 8-bit pulse number modulation coding method. However, one skilled in the art would recognize that the invention may be extended to other systems, e.g. 10 or 12 bit systems. In addition, the present invention may be extended to an interlaced display format. In this extension, the error function is calculated on a frame basis, as individual pixels in the image are addressed on a frame basis. It may be desirable, however, to include in the retinal response model, terms relating to the pixels that surround the one pixel in the intervening field of the interlaced video signal.

In addition, rather than testing each possible PNM code value as an equalizing code value, $y_{eq}$, it may be desirable to limit the code values that are tested to be within some range, for example plus and minus 10 gray scale values from x and y. Finally, while the invention has been described in terms of a plasma display device, it is contemplated that it may be used with any display device that uses pulse number modulation or pulse width modulation, for example a digital micromirror device (DMD) based digital light projector.

While exemplary embodiments of the invention have been shown and described herein, it will be understood that such embodiments are provided by way of example only. Numerous variations, changes, and substitutions will occur to those skilled in the art without departing from the spirit of the invention. Accordingly, it is intended that the appended claims cover all such variations as fall within the spirit and scope of the invention.

What is claimed:

1. A method for determining an equalization code set for use with a pulse number modulation (PNM) code that is used to display video images on a digital display device, the equalization code set acting to reduce moving pixel distortion (MPD) in the displayed images, the method comprising the steps of:

a) determining first and second PNM code values defining a transition between respective first and second gray scale values;

b) selecting a first trial equalization code value in the PNM code;

c) determining a first objective measure of MPD error in a transition from the first PNM code value to the first trial equalization code value and then to the second PNM code value;

d) selecting a second trial equalization code value in the PNM code;

e) determining a second objective measure of MPD error in a transition from the first PNM code value to the second trial equalization code value and then to the second PNM code value;

f) comparing the first objective measure of MPD to the second objective measure of MPD to determine which of the first and second trial equalization code values has a smaller measure of MPD and assigning the respective trial equalization code value having the smaller measure of MPD as a preferred equalization code value;

g) assigning the preferred equalization code value to the equalization code set, whereby the preferred equalization code value replaces the second code value when a transition between the first code value and the second code value is detected.

2. A method according to claim 1, wherein steps d) through g) are repeated for a plurality of respectively different trial equalization code values in the PNM code; and step f) includes the steps of comparing the objective measure of MPD for each of the plurality of trial equalization code values to a previously determined minimum MPD value to determine a smallest objective measure of MPD for the plurality of trial equalization code values and assigning the equalization code corresponding to the smallest objective measure of MPD as the preferred equalization code value.

3. A method according to claim 2, wherein the plurality of respectively different trial equalization code values includes all code values in the PNM code.

4. A method according to claim 1 wherein steps a) through g) are repeated for each pair of code values in the PNM code such that the equalization code set includes a preferred equalization code value for each possible transition between two values in the PNM code.

5. A method according to claim 1, wherein the first and second objective measures of MPD error are determined by the equation:

$$e = \frac{1}{2T}\sqrt{\int_{2T}\min\{e_1(t, y_{eq})^2, e_2(t, y_{eq})^2\}dt}$$

where:

T is one television field period, $y_{eq}$ is the first or second trial equalization value, $$e_1(t, y_{eq}) = |r(t, y_{eq}) - x|$$

$$e_2(t, y_{eq}) = |r(t, y_{eq}) - y|$$

$$r(t, y_{eq}) = \int_t^{t+2T} i(u, x, y_{eq}, y)du, \text{ and}$$

$$r(t, y_{eq}) = \int_t^{t+2T} i(u, x, y_{eq}, y)du$$

represents a model of retinal response to a transition $x \rightarrow y_{eq} \rightarrow y$, where x, $y_{eq}$ and y represent corresponding image picture element (pixel) values in successive image frames.

6. A method according to claim 5, wherein $u(t,x,y_{eq},y)$ is a time-varying rectangular impulse response characteristic representing a moving average of sustain pulses including the sustain pulses corresponding to the code values x, $y_{eq}$, y.

7. A method for determining an N-bit pulse number modulation (PNM) code having optimal moving pixel distortion (MPD) performance comprising the steps of:

a) selecting a sustain pulse assignment for the N-bit PNM code;

b) for each pair of code values, x and y, in the PNM code:

b1) determining a measure of MPD error for a transition between the code values x and y;

b2) comparing the determined measure of MPD error to a threshold value;

b3) If the measure of MPD error is greater than the threshold value determining a code value, $y_{eq}$, such that the measure of MPD error for a transition from x to $y_{eq}$ to y is minimized; and b4) recording $y_{eq}$ as an equalization code value for the transition between x and y and recording the minimized measure of MPD error as being associated with the transition between x and y;

c) repeating steps a) and b) for a plurality of sustain pulse assignments; and d) comparing the recorded minimized measures of MPD errors for each of the plurality of sustain pulse assignments to determine measure of MPD error is least and assigning the N-bit PNM code corresponding to the least measure of MPD error as the N-bit PNM code having optimal MPD performance.

* * * * *